US010813481B2

(12) United States Patent
Hafeznezami

(10) Patent No.: US 10,813,481 B2
(45) Date of Patent: Oct. 27, 2020

(54) ADJUSTABLE PILLOW AND METHODS OF MAKING AND USING SAME

(71) Applicant: Cozy Lines, Inc., Cumming, GA (US)

(72) Inventor: Mohammad Hadi Hafeznezami, Cumming, GA (US)

(73) Assignee: Cozy Lines, Inc., Cumming, GA (US)

( * ) Notice: Subject to any disclaimer, the term of this patent is extended or adjusted under 35 U.S.C. 154(b) by 0 days.

(21) Appl. No.: 16/774,612

(22) Filed: Jan. 28, 2020

(65) Prior Publication Data

US 2020/0237122 A1 Jul. 30, 2020

Related U.S. Application Data

(60) Provisional application No. 62/797,925, filed on Jan. 28, 2019.

(51) Int. Cl.
*A47G 9/10* (2006.01)

(52) U.S. Cl.
CPC ..... *A47G 9/10* (2013.01)

(58) Field of Classification Search
CPC ..... A47G 9/10; A47G 9/0253
See application file for complete search history.

(56) References Cited

U.S. PATENT DOCUMENTS 823,930 A * 6/1906 Coakley ..... A47G 9/0253 5/490
1,068,355 A * 7/1913 McComb ..... A47G 9/10 5/640
2,500,974 A * 3/1950 Angert ..... A47G 9/10 5/645
4,768,247 A * 9/1988 Beier ..... A47G 9/0253 5/490
5,271,114 A * 12/1993 Kjersem ..... A47G 9/0253 5/640
5,363,524 A * 11/1994 Lang ..... A47G 9/1081 5/640
5,758,375 A * 6/1998 Horowitz ..... A47G 9/10 5/640
9,427,087 B2 * 8/2016 Clarke ..... A47C 7/383
9,955,805 B2 * 5/2018 Lou ..... A47G 9/1081
9,980,587 B2 * 5/2018 Miller ..... A47G 9/10
10,321,776 B2 * 6/2019 Hafeznezami ..... A47G 9/10
2002/0138908 A1 * 10/2002 Wang ..... A47G 9/10 5/636

(Continued)

*Primary Examiner* — Eric J Kurilla
(74) *Attorney, Agent, or Firm* — Ballard Spahr LLP

(57) ABSTRACT

A pillow can comprise a cover having a top portion and a bottom portion that cooperate to define a pocket having an interior and an opening opposite a first edge. A first fastener can extend between a front edge and a rear edge of the cover. The first fastener can be configured to close the opening of the pocket so that the pocket has a first length defined as a spacing between the first edge and the first fastener. A second fastener can extend between the front edge and the rear edge of the cover. The second fastener can be configured to close the opening of the pocket so that the pocket has a second length defined as a spacing between the first edge and the second fastener. The second length can be shorter than the first length. When the second fastener is closed, the first fastener can be disposed within the interior of the pocket.

20 Claims, 8 Drawing Sheets

(56) References Cited

U.S. PATENT DOCUMENTS

| | | | | |
|---|---|---|---|---|
| 2012/0073055 | A1* | 3/2012 | Cupo | A47G 9/0253 5/636 |
| 2015/0173535 | A1* | 6/2015 | Reese | A47G 9/0253 5/490 |

* cited by examiner

ADJUSTABLE PILLOW AND METHODS OF MAKING AND USING SAME

CROSS-REFERENCE TO RELATED APPLICATION

The application claims priority to and the benefit of U.S. Provisional Application No. 62/797,925, filed Jan. 28, 2019, the entirety of which is hereby incorporated by reference herein.

FIELD

The disclosure relates to systems, apparatuses, and methods of making and using pillows and, in particular, to pillows that are adjustable to have a selectable height.

BACKGROUND

It is commonly understood that in order to increase an individual's comfort and reduce neck and back strain during resting time, the vertebrae of the individual's spine should be in neutral alignment during sleep. If a pillow provides neck support that is too high or too low, the vertebrae in the neck will be out of alignment with the vertebrae in the rest of the spine. This may reduce the restfulness of the individual's sleep and can aggravate neck and back problems. The level of neck support required for an individual can vary according to body size and sleeping position. Accordingly, it is desirable to have an adjustable neck support which can be quickly and easily adjusted by the individual while lying down. It is also desirable for the pillow to distribute the body weight of the individual to decrease compression on compression points. These features can increase comfort levels, and reduce neck and back strain.

One of the approaches to solving this problem was the development of viscoelastic foam, preformed into an orthopedically designed contour pillow that provided improved support for a user's head and neck. However, this technology suffers from at least two limitations. First, because the ideal level of neck support varies depending on the user's body size and sleeping position, a pre-formed viscoelastic pillow will not provide adequate neck support for all users in all sleeping positions. Secondly, because the viscoelastic foam molds to the individual, the support in the neck region may not be sufficiently firm.

Accordingly, there is still a need for an ergonomic pillow that allows neck support, which can be custom-adjusted to suit the user's individual needs and sleeping patterns. Still further, there is a need for an ergonomic pillow that is simple to produce and is affordable.

SUMMARY

Described herein, in various aspects, is a pillow comprising a cover having a top portion and a bottom portion. The cover can have a perimeter comprising opposing first and second edges, each of the first and second edges having respective front ends and rear ends opposing the front ends, a front edge extending between respective front ends of the first and second edges, and a rear edge extending between respective rear ends of the first and second edges. The top portion of the cover can be coupled to the bottom portion of the cover along the first edge, the front edge, and the rear edge so that the cover defines a pocket having an interior and an opening opposite the first edge. A first fastener can extend between the front edge and the rear edge of the cover. The first fastener can be configured to close the opening of the pocket so that the pocket has a first length defined as a spacing between the first edge and the first fastener. A second fastener can be positioned between the first edge and the first fastener and can extend between the front edge and the rear edge of the cover. The second fastener can be configured to close the opening of the pocket so that the pocket has a second length defined as a spacing between the first edge and the second fastener. The second length can be shorter than the first length. When the second fastener is closed, the first fastener can be disposed within the interior of the pocket.

The pillow can further comprise a third fastener positioned between the first edge and the second fastener and extending between the front edge and the rear edge of the cover. The third fastener can be configured to close the opening of the pocket so that the pocket has a third length defined as a spacing between the first edge and the third fastener. The third length can be shorter than the second length.

When the third fastener is closed, the second fastener can be disposed within the interior of the pocket.

The pillow can further comprise a fourth fastener positioned between the first edge and the third fastener and extending between the front edge and the rear edge of the cover. The fourth fastener can be configured to close the opening of the pocket so that the pocket has a fourth length defined as a spacing between the first edge and the fourth fastener. The fourth length can be shorter than the third length.

When the fourth fastener is closed, the third fastener can be disposed within the interior of the pocket.

The second fastener can be a zipper.

The second fastener can have a first end at the front edge and a second end at the rear edge.

The first fastener can be a zipper.

The second fastener can be a plurality of buttons between the front edge and the rear edge of the cover.

The top portion and bottom portion of the cover can be integrally formed from a single sheet of fabric.

A filler can be disposed within the interior of the pocket.

An inner liner that can be disposed within the interior of the pocket. The filler can be disposed within the inner liner.

The second fastener can be spaced from the first fastener by between one and four inches.

The pillow can optionally not comprise a filler.

A method of using a pillow as disclosed herein can comprise tucking the first fastener into the pocket of the cover of the pillow and closing the second fastener so that the pocket has a second length defined as a spacing between the first edge and the second fastener, wherein the second length is shorter than the first length.

The method can further comprise tucking the second fastener into the pocket and closing the third fastener so that the pocket has a third length defined as a spacing between the first edge and the third fastener, wherein the third length is shorter than the second length.

The method can further comprise tucking the third fastener into the pocket and closing the fourth fastener so that the pocket has a fourth length defined as a spacing between the first edge and the fourth fastener, wherein the fourth length is shorter than the third length.

The method can further comprise opening the second fastener and untucking the first fastener from the pocket.

The method can further comprise shaking the pillow to redistribute the filler.

The method can further comprise opening the second fastener and untucking the second fastener from the pocket.

Additional advantages of the invention will be set forth in part in the description that follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DESCRIPTION OF THE DRAWINGS

These and other features of the preferred embodiments of the invention will become more apparent in the detailed description in which reference is made to the appended drawings wherein.

DETAILED DESCRIPTION

Figure 1:
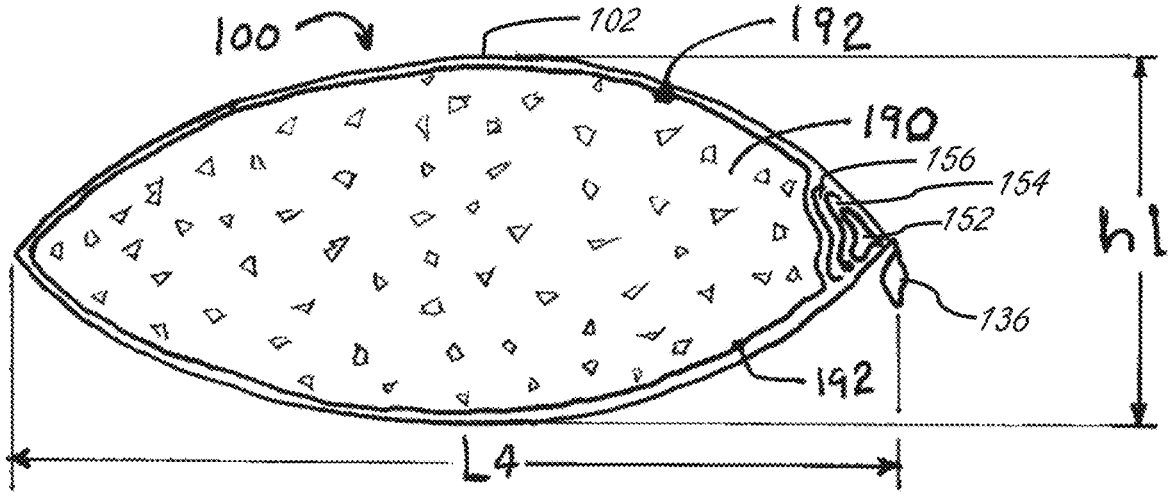
FIG. 1 is a longitudinal cross section of an adjustable pillow, with a bladder insert filled in with loose pillow fill and showing the maximum height, $h_1$, in accordance with various aspects of the present disclosure.

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout. It is to be understood that this invention is not limited to the particular methodology and protocols described, as such may vary. It is also to be understood that the terminology used herein is for the purpose of describing particular embodiments only, and is not intended to limit the scope of the present invention.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

As used herein the singular forms "a," "an," and "the" include plural referents unless the context clearly dictates otherwise. For example, use of the term "a fastener" can refer to one or more of such fasteners, and so forth.

All technical and scientific terms used herein have the same meaning as commonly understood to one of ordinary skill in the art to which this invention belongs unless clearly indicated otherwise.

As used herein, the terms "optional" or "optionally" mean that the subsequently described event or circumstance may or may not occur, and that the description includes instances where said event or circumstance occurs and instances where it does not.

As used herein, the term "at least one of" is intended to be synonymous with "one or more of." For example, "at least one of A, B and C" explicitly includes only A, only B, only C, and combinations of each.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. Optionally, in some aspects, when values are approximated by use of the antecedent "about," it is contemplated that values within up to 15%, up to 10%, up to 5%, or up to 1% (above or below) of the particularly stated value can be included within the scope of those aspects.

The word "or" as used herein means any one member of a particular list and also includes any combination of members of that list.

It is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

The following description supplies specific details in order to provide a thorough understanding. Nevertheless, the skilled artisan would understand that the apparatus, system, and associated methods of using the apparatus can be implemented and used without employing these specific details. Indeed, the apparatus, system, and associated methods can be placed into practice by modifying the illustrated apparatus, system, and associated methods and can be used in conjunction with any other apparatus and techniques conventionally used in the industry.

As used herein, and unless the context clearly indicates otherwise, the term "pillow" is used generically and includes any article comprising a fabric cover, sometimes referred to as a pillow cover, and optionally comprising a filler, that can be used to support a user's position during a resting period. References and descriptions of a pillow are also intended to refer to embodiments of the pillow cover itself without comprising filler. It is understood that, as described herein, the pillow can provide support of the body at rest for comfort, therapeutic benefit, decoration, or play. Pillows of the current invention include all types of pillows that are designed to support the body when lying down, sitting, or both. It is understood that such pillows include but are not limited to neck pillows, body pillows, lumbar pillows, decorative pillows, cushions, and the like.

Figure 8:
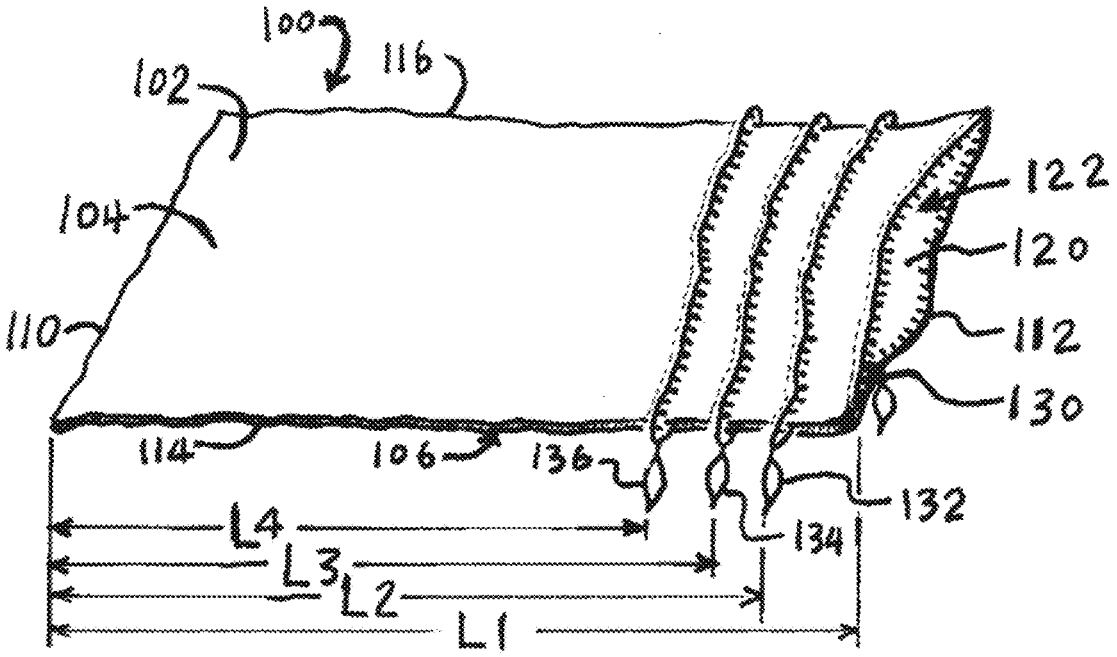
FIG. 8 depicts a perspective view of an empty stitched adjustable pillow showing the portion that defines the main compartment to the left and portions that define the multiple compartments, as in FIGS. 5 and 6, to the right. Fasteners are shown as stitched to the top and bottom exterior of the pillow fabric. The fasteners are all open, and the adjustable pillow is ready to permit insertion of a filled bladder insert into the main pillow compartment.

Disclosed herein, according to various aspects, and with reference to FIGS. 1-8, is an adjustable pillow 100. As shown in FIG. 8, the pillow can comprise a cover 102 having a top portion 104 and a connected bottom portion 106. The cover can have a first edge 110, an opposing second edge 112, a front edge 114 extending between respective front ends of the first edge 110 and the second edge 112, and a rear edge 116 extending between respective rear ends of the first edge 110 and the second edge 112. The top portion 104 and bottom portion 106 of the cover can be connected (e.g., sewn together) along the first edge 110, front edge 114, and rear edge 116 to form a pocket 120 having an opening 122 opposite the first edge 110. According to some optional aspects, the top portion 104 and bottom portion 106 can be formed from a single sheet of fabric and can be integrally formed at one of the first edge 110, the front edge 114, and the rear edge 116.

Figure 4:
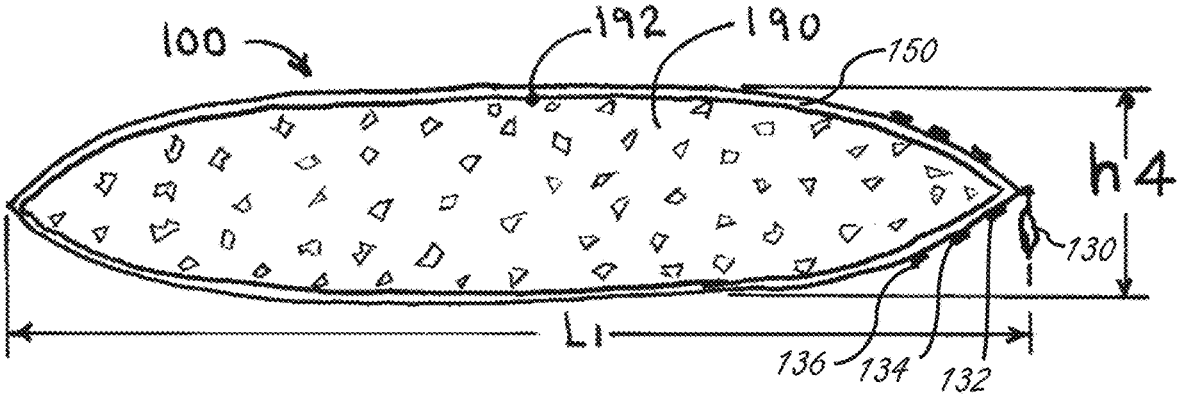
FIG. 4 depicts a longitudinal cross section of the adjustable pillow, with a bladder insert filled in with loose pillow fill and showing a low height, $h_4$, in accordance with various aspects of the present disclosure.
Figure 6:
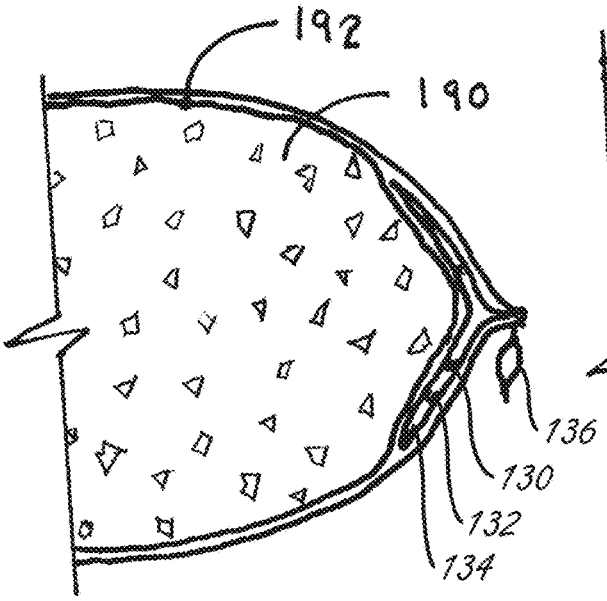
FIG. 6 depicts a cross sectional view of a portion of the pillow in FIG. 1, showing multiple compartments folded and inserted into the pocket of the pillow as in FIG. 1 after redistributing the pillow fill throughout the cover.
Figure 5:
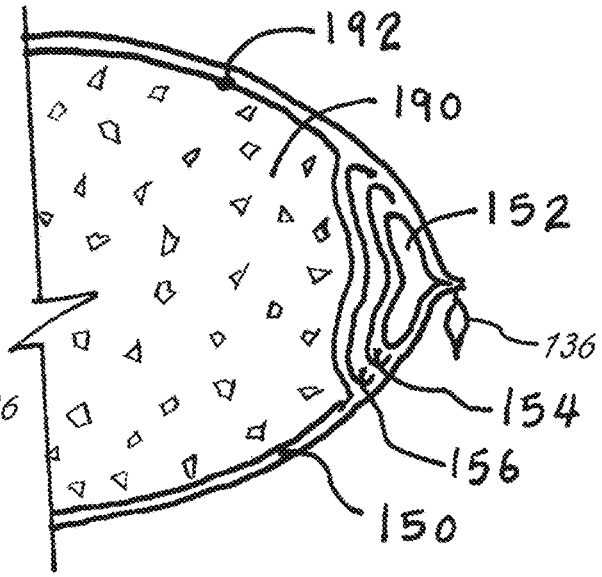
FIG. 5 depicts a cross sectional view of a portion of the pillow in FIG. 1, showing multiple compartments folded and inserted into the pocket of the pillow as in FIG. 1 before redistributing the pillow fill throughout the cover.
Figure 7:
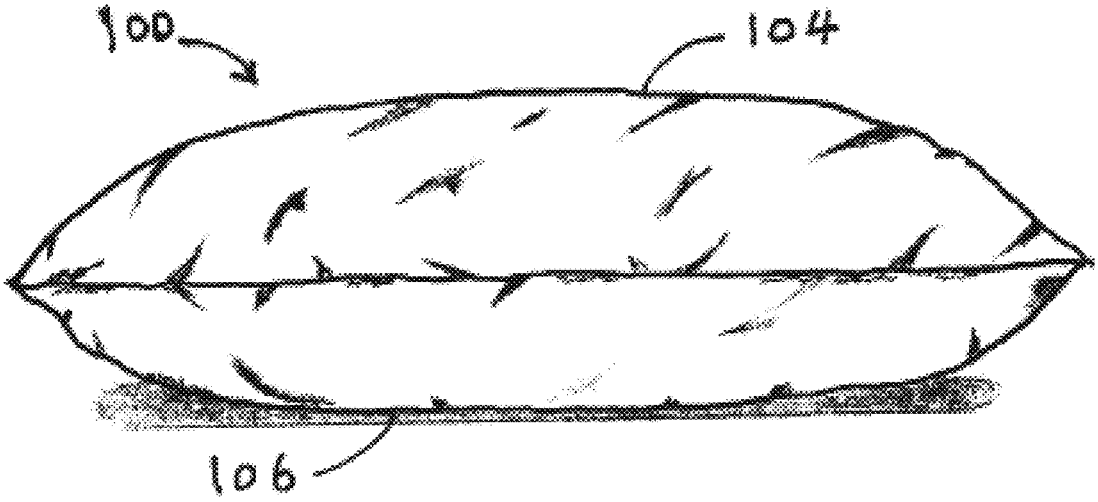
FIG. 7 depicts a side view of the adjustable pillow inserted into a pillow case.

A first fastener 130 can extend between the front edge 114 and the rear edge 116 of the cover 102 at or along the second edge 112. The first fastener 130 can be configured to close the opening of the pocket so that the cover has a first length, $L_1$, defined as a spacing between the first edge 110 and the first fastener 130. The first fastener 130 can have an open configuration and a closed configuration. According to some optional aspects, the first fastener can be a zipper that can be selectively zipped between an unzipped configuration and a zipped configuration. In the closed (e.g., zipped) configuration, the first fastener 130 can close the pillow to define a main compartment 150, as shown in FIGS. 4 and 5. The main compartment 150 can optionally contain a filler material 190, as further disclosed herein.

Figure 3:
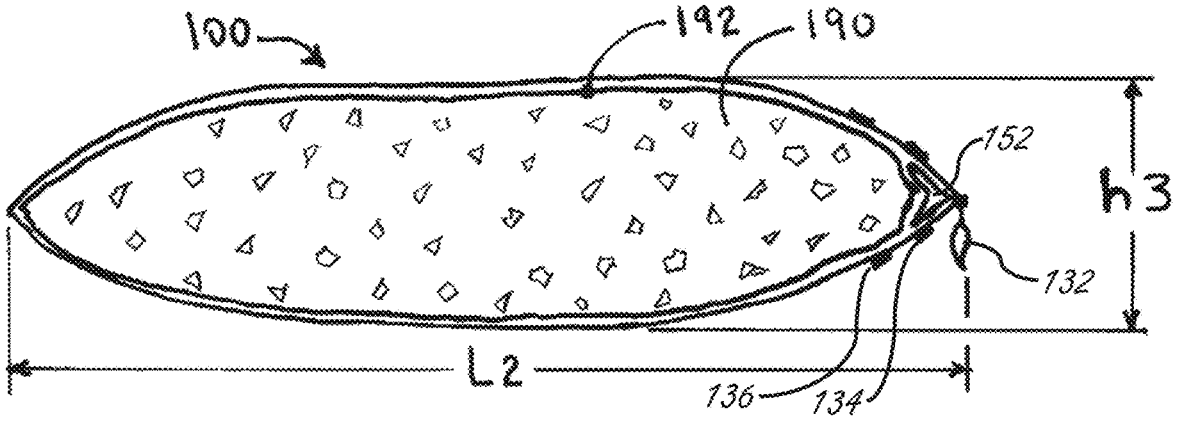
FIG. 3 depicts a longitudinal cross section of the adjustable pillow, with a bladder insert filled in with loose pillow fill and showing a medium-low height, $h_3$, in accordance with various aspects of the present disclosure.

A second fastener 132 can extend between the front edge 114 and the rear edge 116 of the cover 102. The second fastener 132 can be disposed between the first edge 110 of the cover 102 and the first fastener 130. The second fastener 132 can have an open configuration and a closed configuration. According to some optional aspects, the second fastener can be a zipper. The zipper can be selectively zipped between an unzipped configuration and a zipped configuration. In the closed (e.g., zipped) configuration, the second fastener can be configured to close the opening of the pocket so that the cover has a second length, $L_2$, defined as a spacing between the first edge 110 and the second fastener 132. As shown in FIGS. 3 and 5, when the second fastener is in the closed configuration (and the first fastener is in the closed configuration), the cover can define the main compartment 150 and a second compartment 152 that is adjacent the main compartment 150. It should be understood that, in this configuration, the pocket 120 can comprise both of the main compartment 150 and second compartment 152.

Optionally, the second fastener 132 can be positioned with respect to the cover 102 so that the second fastener 132 cannot be closed unless and until the portion of the cover between the second fastener 132 and the second edge 112 (including the first fastener 130) is inwardly folded into and tucked within the pocket. For example, the second fastener 132 can be a zipper having teeth that extend outwardly from the outer surface of the top portion of the cover 102 and complementary teeth that extend outwardly from the outer surface of the bottom portion of the cover. The zipper can optionally extend circumferentially around the cover. Only when the portion of the cover between the second fastener 132 and the second edge is tucked within the pocket can the complementary teeth of the zipper on the top and bottom portions of the cover engage so that the second fastener can be zipped.

Figure 2:
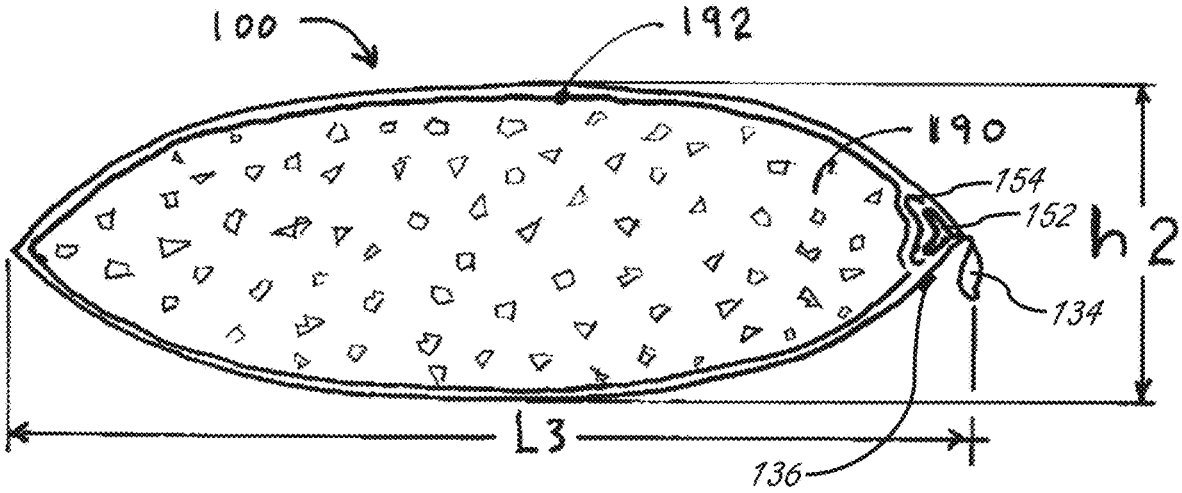
FIG. 2 is a longitudinal cross section of the adjustable pillow, with a bladder insert filled in with loose pillow fill and showing a medium height, $h_2$, in accordance with various aspects of the present disclosure.

A third fastener 134 can extend between the front edge 114 and the rear edge 116 of the cover 102. The third fastener 134 can be disposed between the first edge 110 of the cover 102 and the second fastener 132. The third fastener can have an open configuration and a closed configuration. According to some optional aspects, the third fastener can be a zipper. The zipper can be selectively zipped between an unzipped configuration and a zipped configuration. In the closed (e.g., zipped) configuration, the third fastener can be configured to close the opening of the pocket so that the cover has a third length, $L_3$, defined as a spacing between the first edge 110 and the third fastener 134. As shown in FIGS. 2 and 5, when the third fastener is in the closed configuration (and each of the first and second fasteners is in the closed configuration), the cover can define a third compartment 154, with the second compartment 152 disposed within the third compartment. It should be understood that, in this configuration, the pocket 120 can comprise all of the main compartment 150, the second compartment 152, and the third compartment 154.

Optionally, the third fastener 134 can be positioned with respect to the cover 102 so that the third fastener 134 cannot be closed unless and until the portion of the cover between the third fastener 134 and the second edge 112 (including the first fastener 130 and the second fastener 132) is inwardly folded into and tucked within the pocket. For example, the third fastener 134 can be a zipper having teeth that extend outwardly from the outer surface of the top portion of the cover 102 and complementary teeth that extend outwardly from the outer surface of the bottom portion of the cover. The zipper can optionally extend circumferentially around the cover. Only when the portion of the cover between the third fastener 134 and the second edge is tucked within the pocket can the complementary teeth of the zipper on the top and bottom portions of the cover engage so that the third fastener can be zipped.

A fourth fastener 136 can extend between the front edge 114 and the rear edge 116 of the cover 102. The fourth fastener 136 can be disposed between the first edge 110 of the cover 102 and the third fastener 134. The fourth fastener can have an open configuration and a closed configuration. According to some optional aspects, the fourth fastener can be a zipper. The zipper can be selectively zipped between an unzipped configuration and a zipped configuration. In the closed (e.g., zipped) configuration, the fourth fastener can be configured to close the opening of the pocket so that the cover has a fourth length, $L_4$, defined as a spacing between the first edge 110 and the fourth fastener 136. As shown in FIGS. 1 and 8, when the fourth fastener is in the closed configuration (and each of the first, second, and third fasteners is in the closed configuration), the cover can define a fourth compartment 156, with the third compartment 154 disposed within the fourth compartment. It should be understood that, in this configuration, the pocket 120 can comprise all of the main compartment 150, the second compartment 152, the third compartment 154, and the fourth compartment 156.

Optionally, the fourth fastener 136 can be positioned with respect to the cover 102 so that the fourth fastener 136 cannot be closed unless and until the portion of the cover between the fourth fastener 136 and the second edge 112 (including the first fastener 130, the second fastener 132, and the third fastener 134) is inwardly folded into and tucked within the pocket. For example, the fourth fastener 136 can be a zipper having teeth that extend outwardly from the outer surface of the top portion of the cover 102 and complementary teeth that extend outwardly from the outer surface of the bottom portion of the cover. The zipper can optionally extend circumferentially around the cover. Only when the portion of the cover between the fourth fastener 136 and the second edge is tucked within the pocket can the complementary teeth of the zipper on the top and bottom portions of the cover engage so that the fourth fastener can be zipped.

Figure 13:
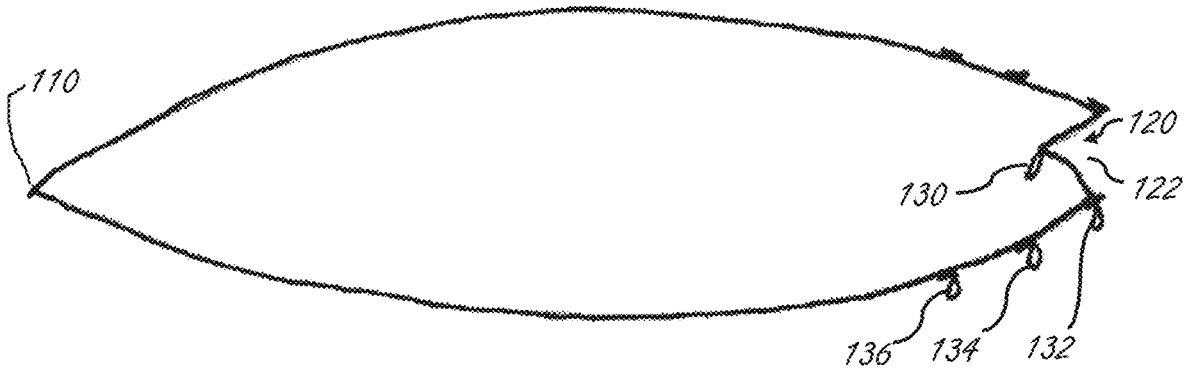
FIG. 13 is a schematic of a cross section of an exemplary adjustable pillow in accordance with embodiments disclosed herein.
Figure 9:
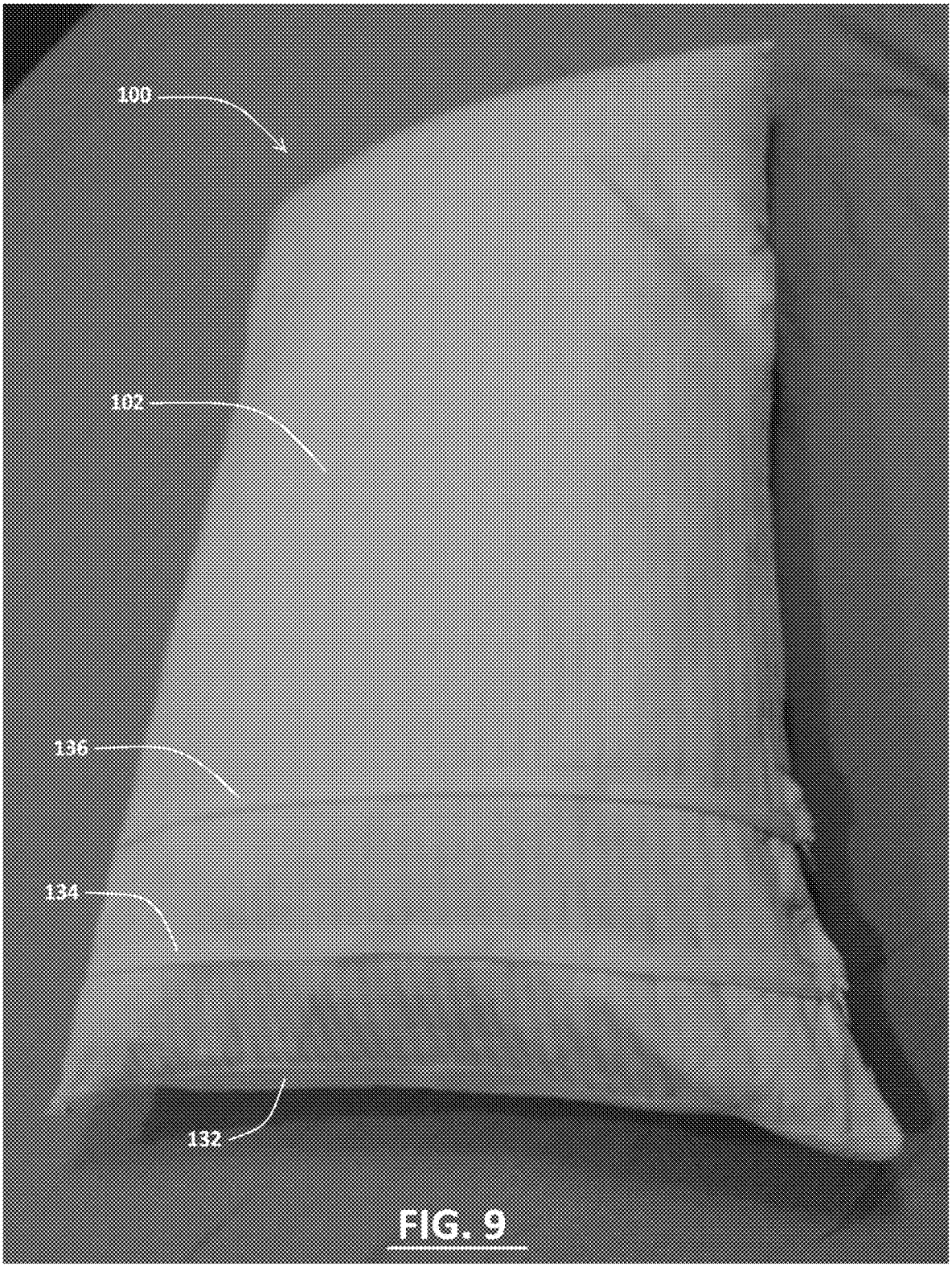
FIG. 9 is an image of an exemplary adjustable pillow in the configuration with the medium-low height, $h_3$, as in FIG. 3.
Figure 10:
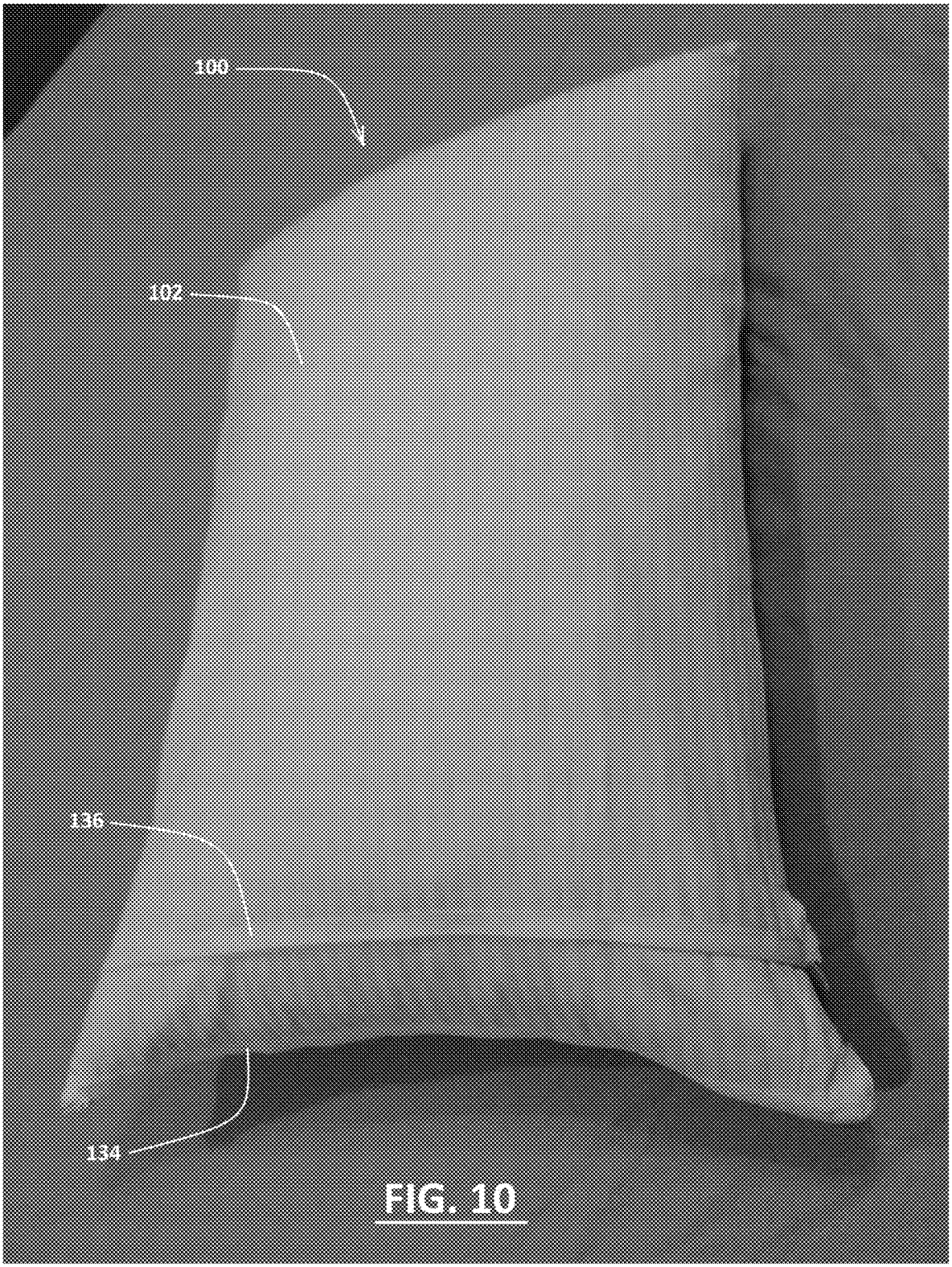
FIG. 10 is an image of an exemplary adjustable pillow in the configuration with the medium height, $h_2$, as in FIG. 2.
Figure 11:
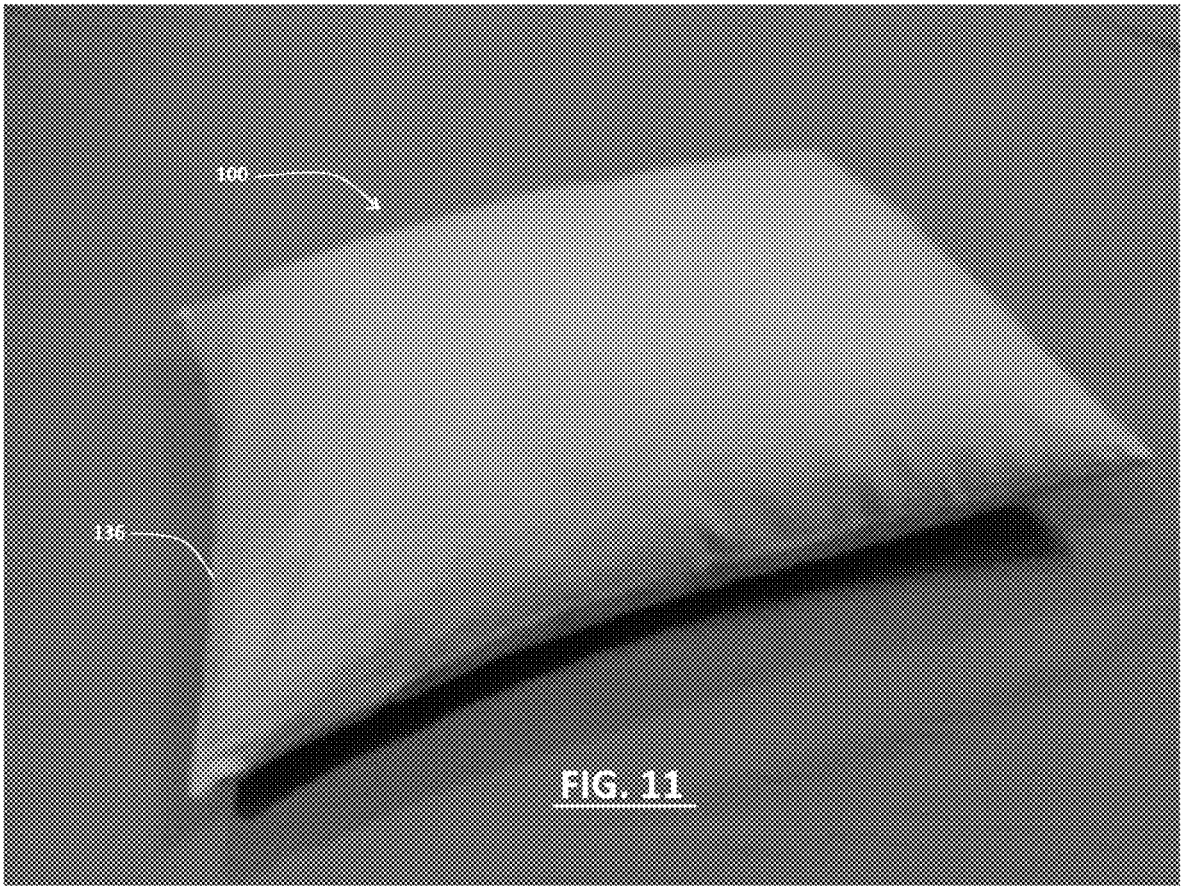
FIG. 11 is an image of an exemplary adjustable pillow in the configuration with the maximum height, $h_1$, as in FIG. 1.
Figure 12:
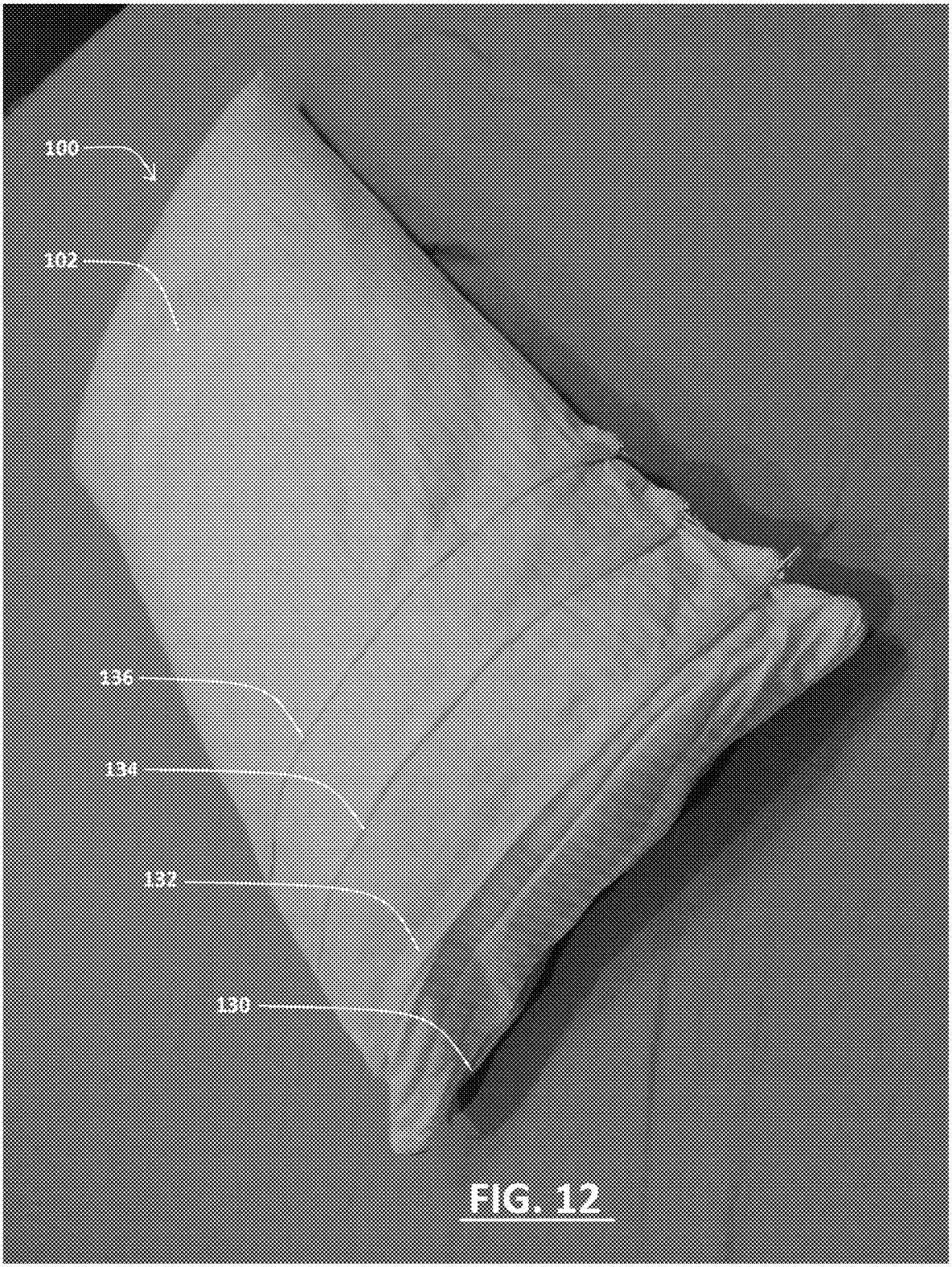
FIG. 12 is an image of an exemplary adjustable pillow in the configuration with the low height, $h_4$, as in FIG. 4.

Accordingly, when at least one fastener is closed, an interior of the pocket can be defined as the volume within the cover between the first edge and the opposing side. If the cover is in its longest configuration so that none of the cover is tucked within the pocket (as in FIG. 8), the opposing side can be the second edge 112. If a portion of the cover is tucked into the pocket, the interior of the pocket can be defined between the first edge and the opposing end at which the portion of the cover is folded back on itself to be tucked into the pocket. For example, the cover can be folded back on itself at the second, third, or fourth fastener, and the interior of the pocket can be the internal space between the first edge and the respective (second, third, or fourth) fastener at which the cover is folded back on itself. Thus, as stated herein, if only the first, second, and third fasteners are closed (as in FIG. 10), the pocket can be defined between the first edge 110 and the third fastener 134. The cover can, therefore, define a partition in the pocket that divides the pocket into separate compartments. As shown in FIG. 8, when the cover is in its longest configuration so that none of the cover is tucked within the pocket, the opening of the pocket can be at the second edge 112 of the cover (where the first fastener is positioned). Referring to FIG. 13, when the cover has a portion of itself tucked within the pocket, the opening of the pocket can be defined as the end of the cover opposite the first edge 110 that folds back upon itself and provides access to the interior of the pocket.

In order to close a given fastener, the portion of the cover and all of the fasteners between the given fastener and the second edge must be tucked into the pocket 120. For example, in order to close the second fastener 132, the portion of the cover between the second fastener 132 and the second edge 112, including the first fastener 130, must be tucked into the pocket 120 prior to closing (e.g., zipping) the second fastener 132. In order to close the third fastener 134, the portion of the cover between the third fastener 134 and the second edge 112, including the first fastener 130 and the second fastener 132, must be tucked into the pocket 120 prior to closing (e.g., zipping) the third fastener 134. In order to close the fourth fastener 136, the portion of the cover between the fourth fastener 136 and the second edge 112, including the first fastener 130, the second fastener 132, and the third fastener 134, must be tucked into the pocket 120 prior to closing (e.g., zipping) the fourth fastener 136. In this way, closing each successive fastener creates a shorter overall length, and, thus, higher, pillow.

In reverse, once a given fastener is opened, the portion of the cover between the given fastener and the next closed fastener can be released from the pocket 120 to extend the length of the pillow. For example, for a pillow in which each of the first, second, third, and fourth fasteners is closed, opening the fourth fastener 136 enables the third fastener 134 and the portion of the cover between the fourth fastener and the third fastener to be removed from the pocket 120. Opening the third fastener 134 then enables the second fastener 132 and the portion of the cover between the third fastener and the second fastener to be removed from the pocket 120. Opening the second fastener 132 then enables the first fastener 130 and the portion of the cover between the second fastener and the first fastener to be removed from the pocket 120.

It is further contemplated that any number of fasteners (e.g., two, three, four, five, six, seven, eight, or more fasteners) can be disposed along the length of the pillow. Each of the fasteners can selectively secure the top portion of the cover to the bottom portion of the cover at the select positions of the respective fasteners along the length of the pillow. It is contemplated that the fasteners can be spaced from each other by about one to about four inches, including exemplary values of about 1.5 inches, about 2 inches, about 2.5 inches, about 3 inches, and about 3.5 inches or more. In further embodiments, smaller and greater fastener spacing distances are contemplated. Optionally, pairs of adjacent fasteners can have the same spacing between each other. In further aspects, the respective spacing between each pair of adjacent fasteners can be different.

The pillow 100 can optionally comprise any filler material 190 known in the art. In certain aspects, the filler can comprise feathers, down, down alternative, foam, shredded memory foam, microbeads, natural and/or synthetic fibers, husks, or any combination thereof. In still further aspects, the filler can comprise a particulate material. In certain aspects, the microbeads can comprise beads of a micrometer size of unexpanded polystyrene material. In yet other exemplary aspects, the husks present in the filler can be obtained from buckwheat seed. It is understood that the filler material can be determined by the level of support provided by the pillow and can be chosen by one of ordinary skill in the art depending on the specific application. It is understood that the fillers are known and available to one of ordinary skill in the art and can be chosen based on the specific application. The filler can be pliable or movable so that as the length of the pillow is extended or contracted, the filler material 190 can be redistributed throughout the pocket.

In still further aspects, the filler can be contained within a liner 192 (e.g., a bladder). In some optional aspects, the liner can be made of a material that can be shaped to adjust to specific compartments or sections to ensure that the filler, while contained in the liner, can be distributed between the compartments or section when needed. For example, the liner 192 can be soft, flexible, and elastic. In this way, as the length of the pillow is extended or contracted, the liner 192 can correspondingly expand and contract to fill the pocket 120.

It should be understood that when only the first fastener is closed and the closed configuration and the pocket has a length $L_1$, the height of the pillow can be $h_4$. When the second fastener is closed, the pocket can have a length $L_2$. Thus, for an equal amount of filler in the pillow, the pillow can have a height of $h_3$ that is greater than $h_4$. Accordingly, a user can form a higher pillow by tucking the portion of the cover between the second fastener 132 and the second edge 112 into the pocket 120 and then closing the second fastener 132. The user can repeat the process for the third and fourth fasteners. Accordingly, when the third fastener is closed, the pocket can have a length $L_3$, providing a corresponding height $h_2$ that is greater than $h_3$. When the fourth fastener is closed, the pocket can have a length $L_4$, providing a corresponding height $h_1$ that is greater than $h_2$. In this way, the user can select a desired pillow height. In the reverse order, to lower the height of the pillow from the configuration shown in FIG. 1, a user can configure the fourth fastener in the open position (e.g., unzip the zipper). Then, upon the user pressing on the pillow or shaking the pillow, the filler can shift so that filler is redistributed throughout the pillow having an increased length, thereby reducing the height of the pillow. The user can repeat the process for the third and second fasteners to selectively reduce the height of the pillow. It can be understood that embodiments disclosed herein can enable rapid height adjustments to the pillow. For example, in certain aspects, the pillow height can be adjusted in under two seconds. Each closed fastener can hide from view the material of the cover 102 between the fastener and the second edge 112 as well as the fasteners between the given fastener and the second edge 112.

Optionally, the maximum height, $h_1$, of the pillow can be about five inches high. It is contemplated that fill material can be added or removed to further adjust the height of the pillow. For example, the bladder can optionally comprise a zipper on an end that enables addition and removal of filler.

According to some aspects, each of the fasteners disclosed herein can be a zipper. The zippers can be, for example, soft-to-touch, invisible zippers. According to further aspects, rather than using zippers, some or all of the fasteners can each be a plurality of buttons or snap fasteners that are positioned along a line between the front edge and the rear edge. The fasteners can optionally attach to the outer surfaces of the cover or the inner surfaces of the cover. In some aspects, fasteners are secured to the fabric by any known in the art means, for example, and without limitation, by sewing, stapling, gluing, and the like. In some aspects, the external fasteners are located in such way that it allows an easy access to the external fasteners, while providing a sufficient aesthetic and comfort level. In some aspects, the fastener can comprise at least two parts. It is understood that the fasteners described herein can comprise any fasteners known in the art. In some aspects, the fasteners can comprise a zipper, a hook and loop, a button, a snap, a hook and eye, a magnet, a grommet, a lace, a fabric tie, or any combination thereof. It is understood that in some aspects, the fasteners of the pillow are the same, while in the other aspects the fasteners are different. In certain aspects, the fasteners can have any additional aesthetic or functional attributes. In certain aspects, the fasteners can further comprise a specific case designed to hide the fastener from view or make the fastener more suitable for use. For example and without any limitations, the fasteners can comprise cushion materials designed to improve the feel for the user and decrease any discomfort that might be present due to the fastener. It is further understood that various fasteners are known and available to one of ordinary skill in the art. It is understood that ordinary skill in the art can easily chose a specific type of fasteners depending on specific application, design and aesthetics.

It is further contemplated that the first fastener can be an unreleasable fastener, such as, for example, a stitched seam.

It is understood that the pillow disclosed herein can be prepared by any methods known in the art. It is further understood that the pillow cover can be made of any material known in the art. In some aspects, the cover can be made of a fabric. In certain aspects, the fabric can be made of natural fibers. In yet other aspects, the fiber can be made of synthetic fibers. In some aspects, the top portion of the cover and the bottom portion of the cover are made of the same continuous fabric. It is understood that the fabric can be any fabric known in the art, for example and without limitation the fabric can comprise textile, non-woven material, can be natural e.g., cotton or synthetic (polyester, nylon, or a blend or a combination thereof; it can also be non-woven synthetic or polymeric material; it can be breathable/permeable and the like. In yet other aspects, the top portion of the cover and the bottom portion of the cover are made of at least two pieces of the fabric. In such aspects, each piece of the at least two pieces of the fabric can be the same or different. It is understood that when each piece of the at least two pieces of the fabric is different from each other, the difference can be exhibited in the type of fabric, color, thickness, length, and the like. It is further understood that the fabric utilized in this disclosure can be easily available to one of ordinary skill in the art and can be chosen depending on an appropriate use.

It is contemplated that the pillow can be generally rectangular. It is further contemplated that the pillow can have rounded corners. In various other embodiments, the pillow can have other shapes, such as, for example, a bolster-shape.

According to some optional aspects, the pillow can have a length of a standard king size pillow (e.g., about 36 inches) when only the first fastener is in the closed configuration. Thus, it is contemplated that one or more additional fasteners can be closed (e.g., zipped) to shorten the length of the pillow in order to fit a smaller bed or fit within a smaller pillowcase (e.g., a queen-sized pillowcase having an exemplary length of about 30 inches). It is further contemplated that the pillow can have any dimensions selected based on the desired application. For example, a pillow in accordance with embodiments disclosed herein can be configured for lumbar support and can therefore be sized to extend along the width of a chair or seat in a car and configured to have a plurality of select heights that can be beneficial for lumbar support (e.g., one inch, two inches, three inches, or more). In some optional aspects, the pillow can have a spacing of about ten inches between the first fastener and the fourth fastener. In some optional aspects, the pillow can have a length of 26 inches from the first edge to the first fastener.

In some optional aspects, each of the top and the bottom portion of the cover can comprise a plurality of pieces of material. For example, the top portion of the cover can comprise a first piece of fabric (or other material) that extends between the first edge and the fourth fastener. The top portion can further comprise a second piece of fabric that extends between the fourth fastener and the third fastener, a third piece of fabric that extends between the third fastener and the second fastener, and a fourth piece of fabric that extends between the second fastener and the first fastener. Thus, adjacent pieces of material can adjoin at a respective fastener. The bottom portion of the cover can be similarly formed of separate sheets of material that are joined at respective fasteners.

Alternatively, in further optional aspects, the second, third, and fourth fasteners are zippers (or zipper portions, such as teeth) that can attach to a single sheet of continuous fabric that extends between the first edge and the second edge to form the top cover. Likewise, the second, third, and fourth fasteners are zippers (or complementary zipper portions, such as teeth) that can attach to a single sheet of continuous fabric that extends between the first edge and the second edge to form the bottom cover.

Optionally, for embodiments in which the fasteners are zippers, each zipper can be stitched to the cover so that the teeth are exposed while at least a portion of the zipper tape is hidden underneath a portion of the cover. That is, a portion of the zipper tape can be positioned against an inside surface of a portion of the cover. In this way, the zipper tape can be hidden to enhance aesthetics and comfort. Further, in optional aspects and as shown in FIGS. 9-12, a portion of the cover (e.g., a flap) can extend over the teeth of the zipper to hide the teeth and enhance the aesthetics and comfort of the pillow.

EXEMPLARY ASPECTS

In view of the described products, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A pillow comprising: a cover having a top portion and a bottom portion, wherein the cover has a perimeter comprising: opposing first and second edges, each of the first and second edges having respective front ends and rear ends opposing the front ends; a front edge extending between respective front ends of the first and second edges; and a rear edge extending between respective rear ends of the first and second edges, wherein the top portion of the cover is coupled to the bottom portion of the cover along the first edge, the front edge, and the rear edge so that the cover defines a pocket having an interior and an opening opposite the first edge; a first fastener extending between the front edge and the rear edge of the cover, wherein the first fastener is configured to close the opening of the pocket so that the pocket has a first length defined as a spacing between the first edge and the first fastener; and a second fastener positioned between the first edge and the first fastener and extending between the front edge and the rear edge of the cover, wherein the second fastener is configured to close the opening of the pocket so that the pocket has a second length defined as a spacing between the first edge and the second fastener, wherein the second length is shorter than the first length, and wherein, when the second fastener is closed, the first fastener is disposed within the interior of the pocket.

Aspect 2: The pillow of aspect 1, further comprising a third fastener positioned between the first edge and the second fastener and extending between the front edge and the rear edge of the cover, wherein the third fastener is configured to close the opening of the pocket so that the pocket has a third length defined as a spacing between the first edge and the third fastener, wherein the third length is shorter than the second length.

Aspect 3: The pillow of aspect 2, wherein, when the third fastener is closed, the second fastener is disposed within the interior of the pocket.

Aspect 4: The pillow of aspect 2 or aspect 3, further comprising a fourth fastener positioned between the first edge and the third fastener and extending between the front edge and the rear edge of the cover, wherein the fourth fastener is configured to close the opening of the pocket so that the pocket has a fourth length defined as a spacing between the first edge and the fourth fastener, wherein the fourth length is shorter than the third length.

Aspect 5: The pillow of aspect 4, wherein, when the fourth fastener is closed, the third fastener is disposed within the interior of the pocket.

Aspect 6: The pillow of aspect 1, wherein the second fastener is a zipper.

Aspect 7: The pillow of any one of the preceding aspects, wherein the second fastener has a first end at the front edge and a second end at the rear edge.

Aspect 8: The pillow of any one of the preceding aspects, wherein the first fastener is a zipper.

Aspect 9: The pillow of any one of aspects 1-5, wherein the second fastener is a plurality of buttons between the front edge and the rear edge of the cover.

Aspect 10: The pillow of any one of the preceding aspects, wherein the top portion and bottom portion of the cover are integrally formed from a single sheet of fabric.

Aspect 11: The pillow of any one of the preceding aspects, further comprising a filler within the interior of the pocket.

Aspect 12: The pillow of aspect 11, further comprising an inner liner that is disposed within the interior of the pocket, wherein the filler is disposed within the inner liner.

Aspect 13: The pillow of any one of the preceding aspects, wherein the second fastener is spaced from the first fastener by between one and four inches.

Aspect 14: The pillow of any one of aspects 1-10, wherein the pillow does not comprise a filler.

Aspect 15: A method of using a pillow comprising: a cover having a top portion and a bottom portion, wherein the cover has a perimeter comprising: opposing first and second edges, each of the first and second edges having respective front ends and rear ends opposing the front ends; a front edge extending between respective front ends of the first and second edges; and a rear edge extending between respective rear ends of the first and second edges, wherein the top portion of the cover is coupled to the bottom portion of the cover along the first edge, the front edge, and the rear edge so that the cover defines a pocket having an interior and an opening opposite the first edge; a first fastener extending between the front edge and the rear edge of the cover, wherein the first fastener is configured to close the opening of the pocket so that the pocket has a first length defined as a spacing between the first edge and the first fastener; and a second fastener positioned between the first edge and the first fastener and extending between the front edge and the rear edge of the cover, the method comprising: tucking the first fastener into the pocket of the cover of the pillow; and closing the second fastener so that the pocket has a second length defined as a spacing between the first edge and the second fastener, wherein the second length is shorter than the first length.

Aspect 16: The method of aspect 15, wherein the pillow further comprises a third fastener positioned between the first edge and the second fastener and extending between the front edge and the rear edge of the cover, the method further comprising: tucking the second fastener into the pocket; and closing the third fastener so that the pocket has a third length defined as a spacing between the first edge and the third fastener, wherein the third length is shorter than the second length.

Aspect 17: The method of aspect 16, wherein the pillow further comprises a fourth fastener positioned between the first edge and the third fastener and extending between the front edge and the rear edge of the cover, the method further comprising: tucking the third fastener into the pocket; and closing the fourth fastener so that the pocket has a fourth length defined as a spacing between the first edge and the fourth fastener, wherein the fourth length is shorter than the third length.

Aspect 18: The method of aspect 15, further comprising: opening the second fastener; and untucking the first fastener from the pocket.

Aspect 19: The method of aspect 18, wherein the pillow further comprises a filler, the method further comprising: shaking the pillow to redistribute the filler.

Aspect 20: The method of aspect 16, further comprising: opening the third fastener; and untucking the second fastener from the pocket.

Aspect 21: A cover comprising: a top portion and a bottom portion, wherein the cover has a perimeter comprising a first edge, a second edge, each of the first and second edges having front ends and opposing rear ends, a front edge extending between respective front ends of the first and second edges, and a rear edge extending between respective rear ends of the first and second edges, wherein the top portion is coupled to the bottom portion along the first edge, front edge, and rear edge, so that the cover defines a pocket having an interior and an opening opposite the first edge; a first fastener extending between the front edge and the rear edge of the cover, wherein the first fastener is configured to close the opening of the pocket so that the pocket has a first length defined as a spacing between the first edge and the first fastener; and a second fastener extending between the front edge and the rear edge of the cover, wherein the second fastener is configured to close the opening of the pocket so that the pocket has a second length defined as a spacing between the first edge and the second fastener, wherein the second length is shorter than the first length, wherein, when the second fastener is closed, the first fastener is disposed within the interior of the pocket.

Aspect 22: A cover comprising: an upper portion; a connected lower portion, wherein the cover has a first edge, a second edge and a length defined between the first edge and the second edge, wherein the upper portion and lower portion cooperate to define a main compartment; a first fastener disposed at the second edge of the cover; and a second fastener disposed along the length between the first edge of the cover and the first fastener, wherein each of the first fastener and the second fastener has an open configuration and a closed configuration, wherein, when the first fastener is in the closed configuration and the second fastener is in the closed position, the cover defines a first compartment and a second compartment adjacent to the first compartment.

Aspect 23: The cover of aspect 22, further comprising a third fastener disposed between the second fastener and the second edge, wherein the third fastener has an open configuration and a closed configuration, wherein, when each of the first fastener, the second fastener, and the third fastener is in the closed configuration, the cover defines a third compartment that receives the second compartment.

Aspect 24: The cover of aspect 23, further comprising a fourth fastener disposed between the third fastener and the second edge, wherein the fourth fastener has an open configuration and a closed configuration, wherein, when each of the first fastener, the second fastener, the third fastener, and the fourth fastener is in the closed configuration, the cover defines a fourth compartment that receives the third compartment.

Aspect 25: The cover of any one of aspects 22-24, further comprising a filler within the interior of the pocket.

Aspect 26: The cover of aspect 25, further comprising an inner liner that is disposed within the interior of the pocket, wherein the filler is disposed within the inner liner.

Although the foregoing invention has been described in some detail by way of illustration and example for purposes of clarity of understanding, certain changes and modifications may be practiced within the scope of the appended claims.

What is claimed is:

1. A pillow having a longitudinal axis, the pillow comprising:

a cover having a top portion and a bottom portion, wherein the cover has a perimeter comprising:

opposing first and second edges, each of the first and second edges having respective front ends and rear ends opposing the front ends;

a front edge extending between respective front ends of the first and second edges; and a rear edge extending between respective rear ends of the first and second edges, wherein the top portion of the cover is coupled to the bottom portion of the cover along the first edge, the front edge, and the rear edge so that the cover defines a pocket having an interior and an opening opposite the first edge;

a first fastener extending between the front edge and the rear edge of the cover, wherein the first fastener is configured to close the opening of the pocket so that the pocket has a first length defined as a spacing between the first edge and the first fastener relative to the longitudinal axis of the pillow; and a second fastener positioned between the first edge and the first fastener and extending between the front edge and the rear edge of the cover, wherein the second fastener is configured to close the opening of the pocket so that the pocket has a second length defined as a spacing between the first edge and the second fastener relative to the longitudinal axis of the pillow, wherein the second length is shorter than the first length, and wherein, when the second fastener is closed, the first fastener is disposed within the interior of the pocket and between the second fastener and the first edge relative to the longitudinal axis of the pillow.

2. The pillow of claim 1, further comprising a third fastener positioned between the first edge and the second fastener and extending between the front edge and the rear edge of the cover, wherein the third fastener is configured to close the opening of the pocket so that the pocket has a third length defined as a spacing between the first edge and the third fastener relative to the longitudinal axis of the pillow, wherein the third length is shorter than the second length.

3. The pillow of claim 2, wherein, when the third fastener is closed, the second fastener is disposed within the interior of the pocket and between the third fastener and the first edge relative to the longitudinal axis of the pillow.

4. The pillow of claim 2, further comprising a fourth fastener positioned between the first edge and the third fastener and extending between the front edge and the rear edge of the cover, wherein the fourth fastener is configured to close the opening of the pocket so that the pocket has a fourth length defined as a spacing between the first edge and the fourth fastener relative to the longitudinal axis of the pillow, wherein the fourth length is shorter than the third length.

5. The pillow of claim 4, wherein, when the fourth fastener is closed, the third fastener is disposed within the interior of the pocket and between the fourth fastener and the first edge relative to the longitudinal axis of the pillow.

6. The pillow of claim 1, wherein the second fastener is a zipper.

7. The pillow of claim 6, wherein the second fastener has a first end at the front edge and a second end at the rear edge.

8. The pillow of claim 1, wherein the first fastener is a zipper.

9. The pillow of claim 1, wherein the second fastener is a plurality of buttons between the front edge and the rear edge of the cover.

10. The pillow of claim 1, wherein the top portion and bottom portion of the cover are integrally formed from a single sheet of fabric.

11. The pillow of claim 1, further comprising a filler within the interior of the pocket.

12. The pillow of claim 11, further comprising an inner liner that is disposed within the interior of the pocket, wherein the filler is disposed within the inner liner.

13. The pillow of claim 1, wherein the second fastener is spaced from the first fastener by between one and four inches.

14. The pillow of claim 1, wherein the pillow does not comprise a filler.

15. A method of using a pillow having a longitudinal axis, the method comprising:

a cover having a top portion and a bottom portion, wherein the cover has a perimeter comprising:

opposing first and second edges, each of the first and second edges having respective front ends and rear ends opposing the front ends;

a front edge extending between respective front ends of the first and second edges; and a rear edge extending between respective rear ends of the first and second edges, wherein the top portion of the cover is coupled to the bottom portion of the cover along the first edge, the front edge, and the rear edge so that the cover defines a pocket having an interior and an opening opposite the first edge;

a first fastener extending between the front edge and the rear edge of the cover, wherein the first fastener is configured to close the opening of the pocket so that the pocket has a first length defined as a spacing between the first edge and the first fastener relative to the longitudinal axis of the pillow; and a second fastener positioned between the first edge and the first fastener and extending between the front edge and the rear edge of the cover, the method comprising:

tucking the first fastener into the pocket of the cover of the pillow so that the first fastener is disposed between the second fastener and the first edge relative to the longitudinal axis of the pillow; and closing the second fastener so that the pocket has a second length defined as a spacing between the first edge and the second fastener relative to the longitudinal axis of the pillow, wherein the second length is shorter than the first length.

16. The method of claim 15, wherein the pillow further comprises a third fastener positioned between the first edge and the second fastener and extending between the front edge and the rear edge of the cover, the method further comprising:

tucking the second fastener into the pocket so that the second fastener is disposed between the third fastener and the first edge relative to the longitudinal axis of the pillow; and closing the third fastener so that the pocket has a third length defined as a spacing between the first edge and the third fastener relative to the longitudinal axis of the pillow, wherein the third length is shorter than the second length.

17. The method of claim 16, wherein the pillow further comprises a fourth fastener positioned between the first edge and the third fastener and extending between the front edge and the rear edge of the cover, the method further comprising:

tucking the third fastener into the pocket so that the third fastener is disposed between the fourth fastener and the first edge relative to the longitudinal axis of the pillow; and closing the fourth fastener so that the pocket has a fourth length defined as a spacing between the first edge and the fourth fastener relative to the longitudinal axis of the pillow, wherein the fourth length is shorter than the third length.

18. The method of claim 16, further comprising:

opening the third fastener; and untucking the second fastener from the pocket.

19. The method of claim 15, further comprising:

opening the second fastener; and untucking the first fastener from the pocket.

20. The method of claim 19, wherein the pillow further comprises a filler, the method further comprising: shaking the pillow to redistribute the filler.

* * * * *